US011284764B1

(12) United States Patent
Ma

(10) Patent No.: US 11,284,764 B1
(45) Date of Patent: Mar. 29, 2022

(54) TELESCOPIC CONDUCTIVE TUBE

(71) Applicant: Shenzhen Shermon Technology Co., Limited, Shenzhen (CN)

(72) Inventor: Chaoliang Ma, Shenzhen (CN)

(73) Assignee: SHENZHEN SHERMON TECHNOLOGY CO., LIMITED, Shenzhen (CN)

( * ) Notice: Subject to any disclaimer, the term of this patent is extended or adjusted under 35 U.S.C. 154(b) by 0 days.

(21) Appl. No.: 17/184,532

(22) Filed: Feb. 24, 2021

(30) Foreign Application Priority Data

Feb. 2, 2021 (CN) ..... 202120298311.6

(51) Int. Cl.
*A47L 9/24* (2006.01)

(52) U.S. Cl.
CPC ..... *A47L 9/244* (2013.01); *A47L 9/246* (2013.01)

(58) Field of Classification Search
CPC ..... A47L 9/244; A47L 9/246
USPC ..... 15/414
See application file for complete search history.

(56) References Cited

U.S. PATENT DOCUMENTS 3,534,317 A * 10/1970 Erik ..... A47L 9/246 439/10
3,961,647 A * 6/1976 Doubleday ..... A47L 9/248 138/103
5,740,583 A * 4/1998 Shimada ..... A47L 9/244 15/377
6,148,474 A * 11/2000 Ohara ..... A47L 9/244 15/377
7,883,116 B2 * 2/2011 Canale ..... A47L 9/244 285/7
8,677,595 B2 * 3/2014 Zeng ..... A47L 9/248 29/434
9,155,438 B2 * 10/2015 Park ..... A47L 9/246
11,019,971 B2 * 6/2021 Zhang ..... A47L 9/248
2002/0020541 A1 * 2/2002 Stein ..... A47L 9/244 174/47
2019/0208974 A1 * 7/2019 Oka ..... A47L 9/246

FOREIGN PATENT DOCUMENTS

CN 205921172 U * 2/2017 ..... A63H 33/08
EP 0835632 A2 * 4/1998 ..... A47L 9/246
JP H0984728 A * 3/1997
JP H0994191 A * 4/1997

(Continued)

*Primary Examiner* — Joseph J Hail
*Assistant Examiner* — Jonathan R Zaworski

(57) ABSTRACT

A telescopic conductive tube is provided in the present application, including a telescopic assembly and a conductive assembly, wherein the telescopic assembly is provided with a first tube body and a second tube body relatively telescopic to the first tube body, and the conductive assembly is installed along the outside of the first and second tube body, wherein the conductive assembly includes a conductive wire, a receiving aluminum tube, an electrical connecting head, a conductive copper sheet, and an insulated guide rail, wherein the conductive wire is electrically connected with an elastic contact protruding from the inside to the outside of the electrical connecting head, the electrical connecting head being electrically connected to the conductive copper sheet, and the electrical connecting head and the conductive copper sheet being capable of sliding relatively and maintaining electrical connection.

9 Claims, 7 Drawing Sheets

(56) References Cited

FOREIGN PATENT DOCUMENTS

| | | | | | |
|---|---|---|---|---|---|
| JP | 3540052 | B2 | * | 7/2004 | |
| JP | 2013212209 | A | * | 10/2013 | |
| KR | 100222645 | B1 | * | 10/1999 | |
| KR | 200157810 | Y1 | * | 10/1999 | |
| KR | 200157820 | Y1 | * | 10/1999 | |
| KR | 200181843 | Y1 | * | 5/2000 | ..... A47L 9/246 |
| KR | 100438862 | B1 | * | 7/2004 | |
| KR | 100809744 | B1 | * | 3/2008 | ..... A47L 9/246 |

* cited by examiner

TELESCOPIC CONDUCTIVE TUBE

CROSS-REFERENCE TO RELATED APPLICATIONS

This application claims priority to Chinese Patent Application No. 202120298311.6, filed Feb. 2, 2021, the contents of which are incorporated herein by reference.

BACKGROUND

1. Technical Field

The present application relates to a field of vacuum cleaner accessories technology, especially to a telescopic conductive tube.

2. Description of Related Art

An handheld vacuum cleaner is known to basically include a vacuum cleaner body, a vacuum head, and a vacuum tube that connects the vacuum head with the vacuum cleaner body. The vacuum tube is also provided with a conductive assembly which is controlled by the vacuum cleaner body, and the power is directed to the vacuum head through the conductive assembly to make the vacuum head work. However, the current vacuum tube is a whole section, and it is very inconvenient from the perspective of carrying because the size and length of the vacuum tube are larger than the length or width of the vacuum cleaner body and the vacuum head. Therefore, it is difficult to be favored by consumers. At the same time, it brings great inconvenience to the packaging for sales. In order to overcome the above-mentioned defects, some manufacturers have replaced the vacuum tube with a telescopic type. However, in the process of achieving telescopic, it has brought many defects, which include that the conductive assembly must be set to be enabled to expand and contract relatively with the telescopic of the vacuum tube. The design or structure of the conductive assembly is therefore very complicated, and it is inconvenient to maintain the conductive assembly once there is an accident in use. In the invention patent with the application number 201610063853.9, a conductive telescopic tube and a handheld vacuum cleaner are proposed. In the proposed conductive telescopic tube, elastic sheets are provided on both sides of the conductive joints, and the elastic sheets are electrically connected to the contact strips. The elastic sheets are thin and easy to lose elasticity. After being used for a long time, the elastic sheets are easy to be further bent or broken, thereby affecting the electrical connection with the contact strip. Moreover, the contact strip in the first tube in this patent is directly installed in the first tube, and it is not easy to replace the contact strip when it is damaged.

DETAILED DESCRIPTION

The present application will be further described below with reference to the accompanying drawings for further clearly and fully discussing the technical solutions of the present invention.

Figure 1:
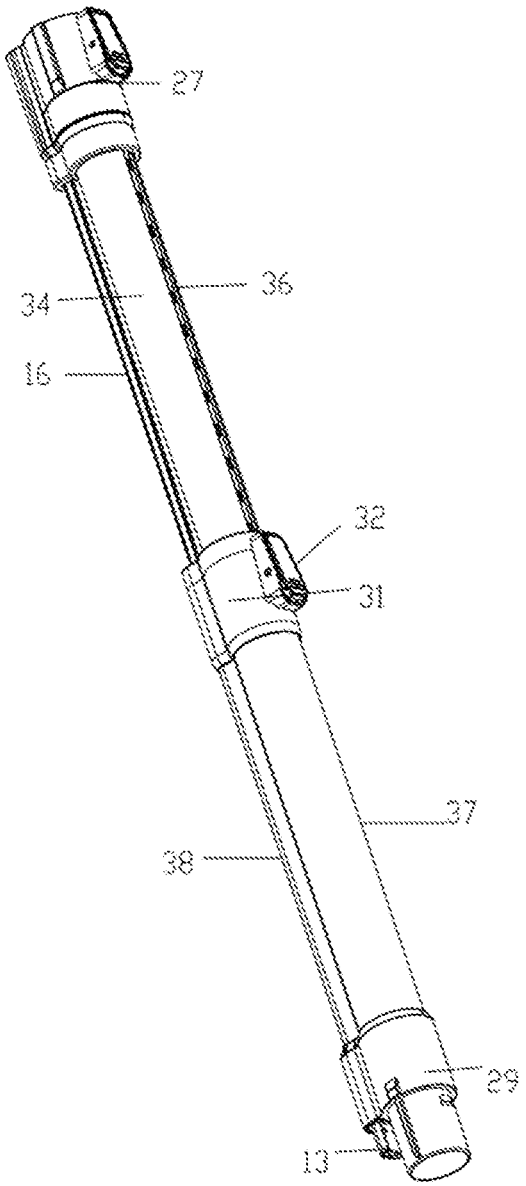
FIG. 1 shows a schematic view of the structure of the telescopic conductive tube according to the present application.
Figure 2:
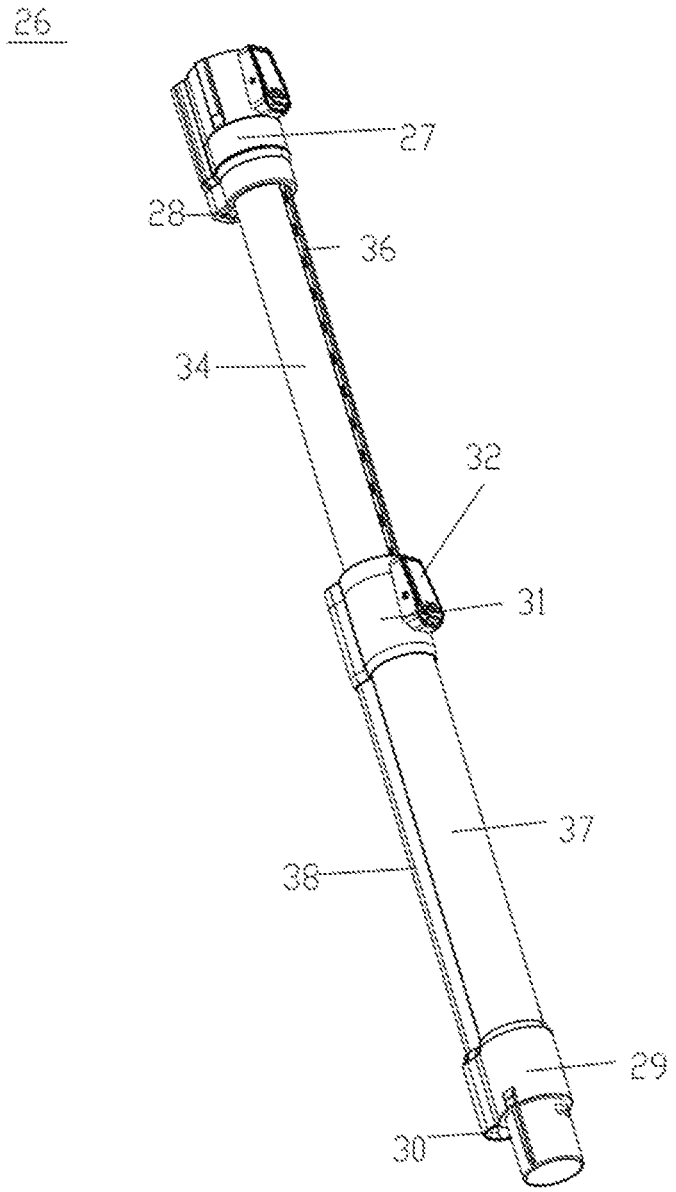
FIG. 2 shows a schematic view of the structure of the telescopic assembly according to the present application.
Figure 3:
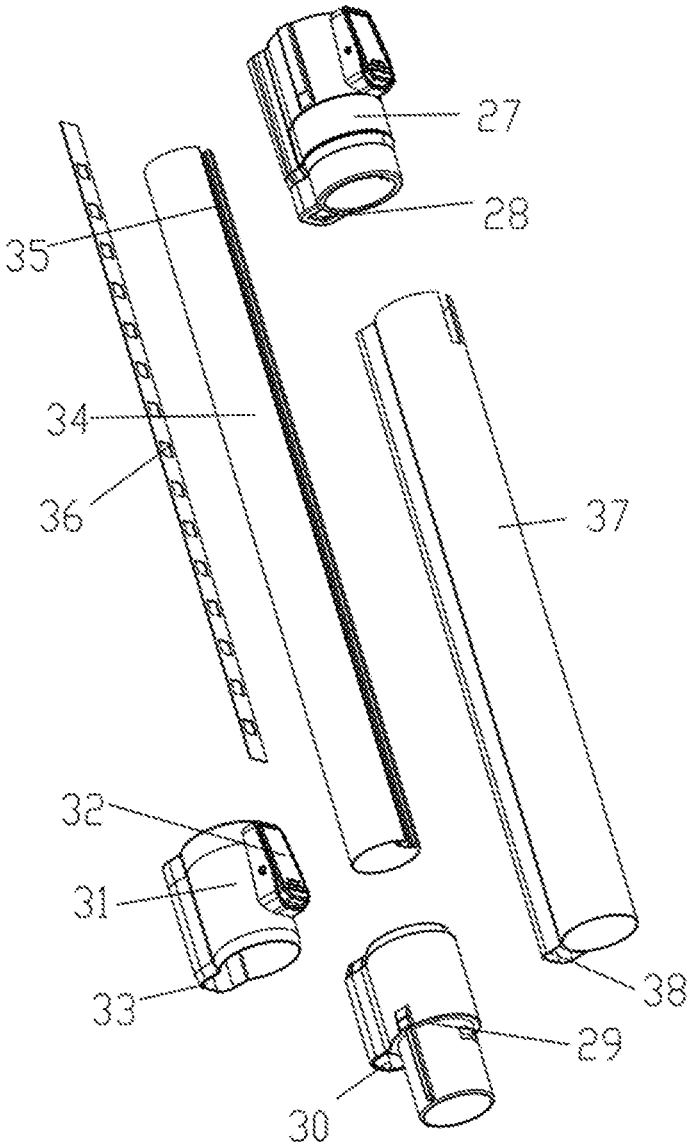
FIG. 3 shows am exploded view of the telescopic assembly according to the present application.
Figure 4:
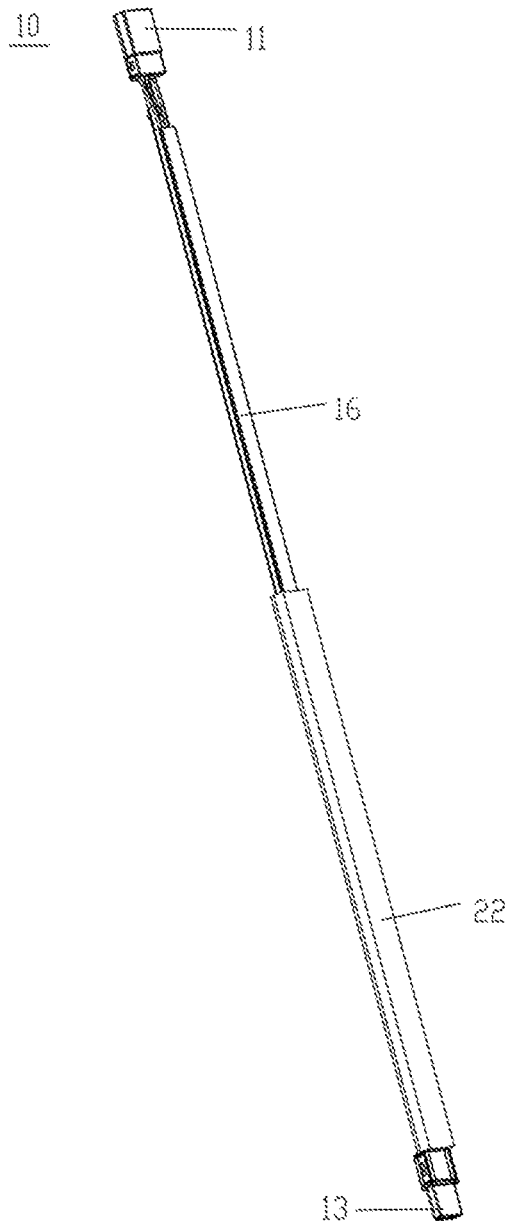
FIG. 4 shows a schematic view of the structure of the conductive assembly according to the present application.
Figure 5:
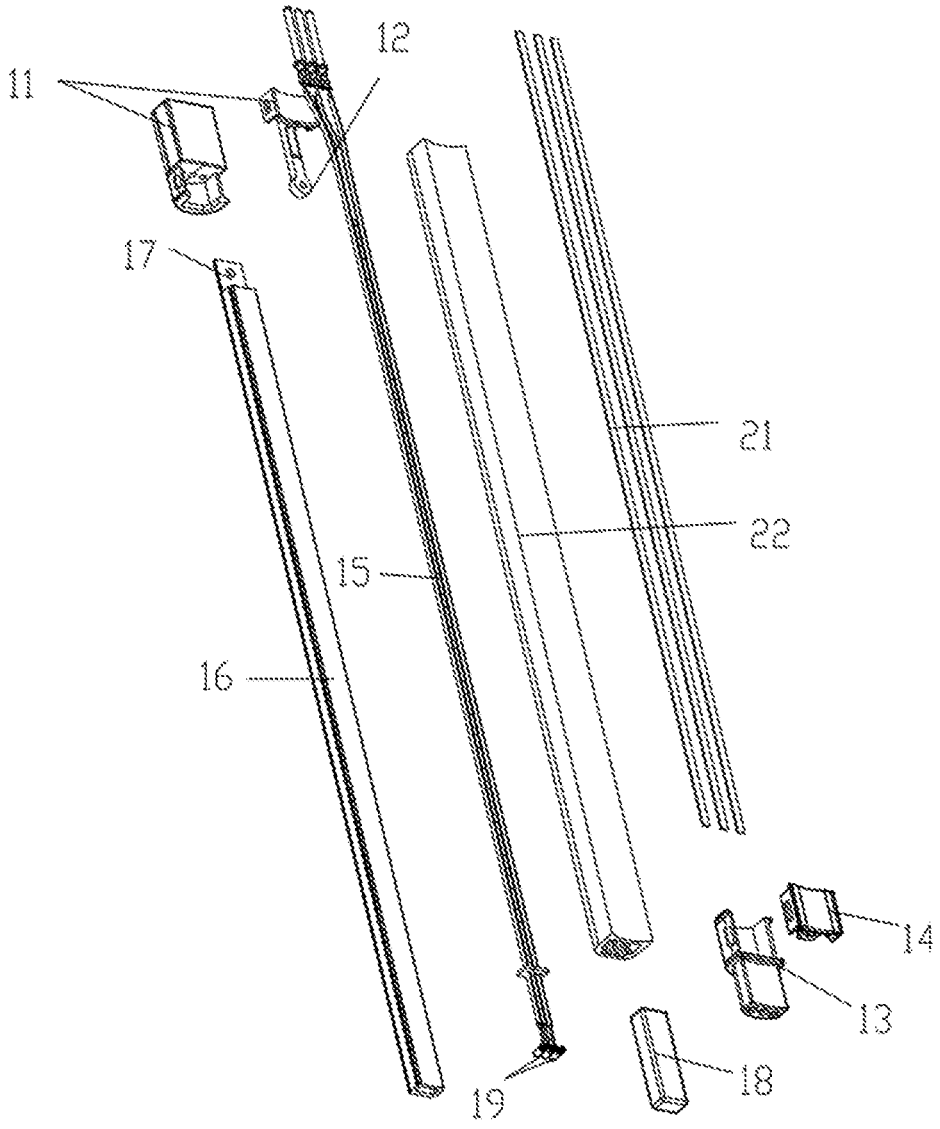
FIG. 5 shows am exploded view of the conductive assembly according to the present application.
Figure 6:
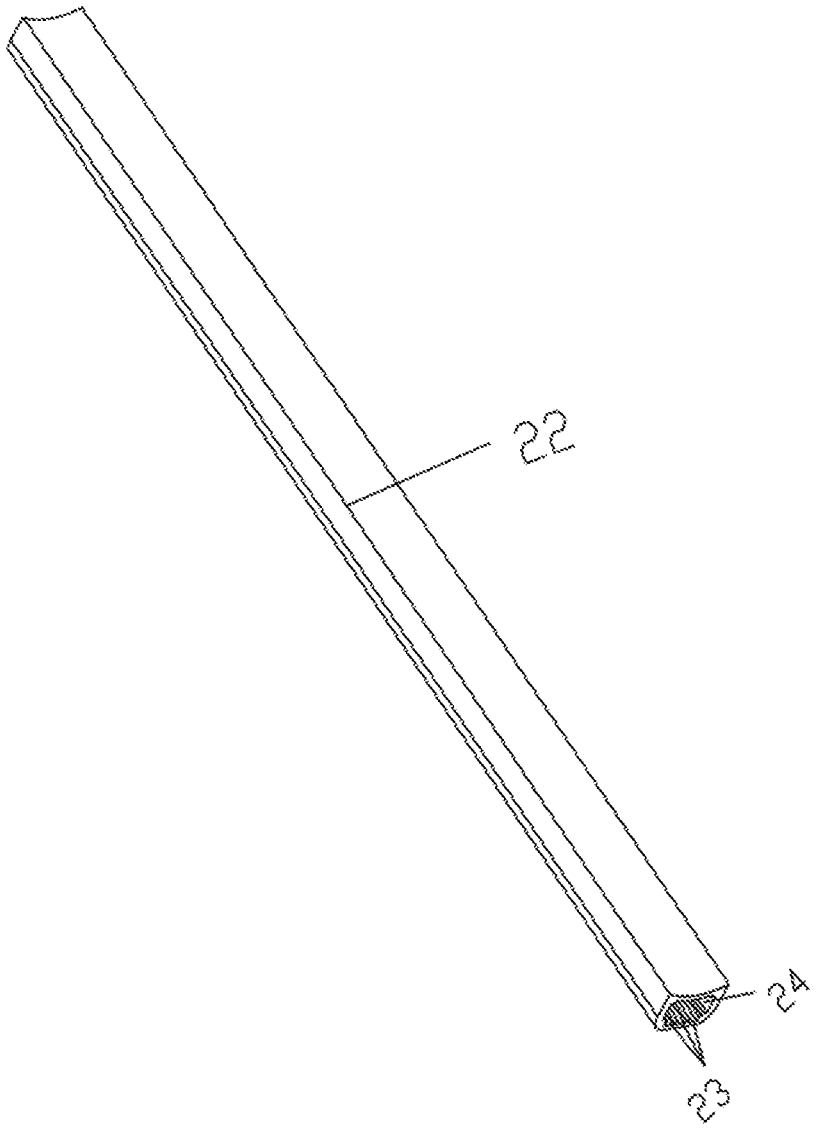
FIG. 6 shows a schematic view of the structure of the insulated guide rail according to the present application.
Figure 7:
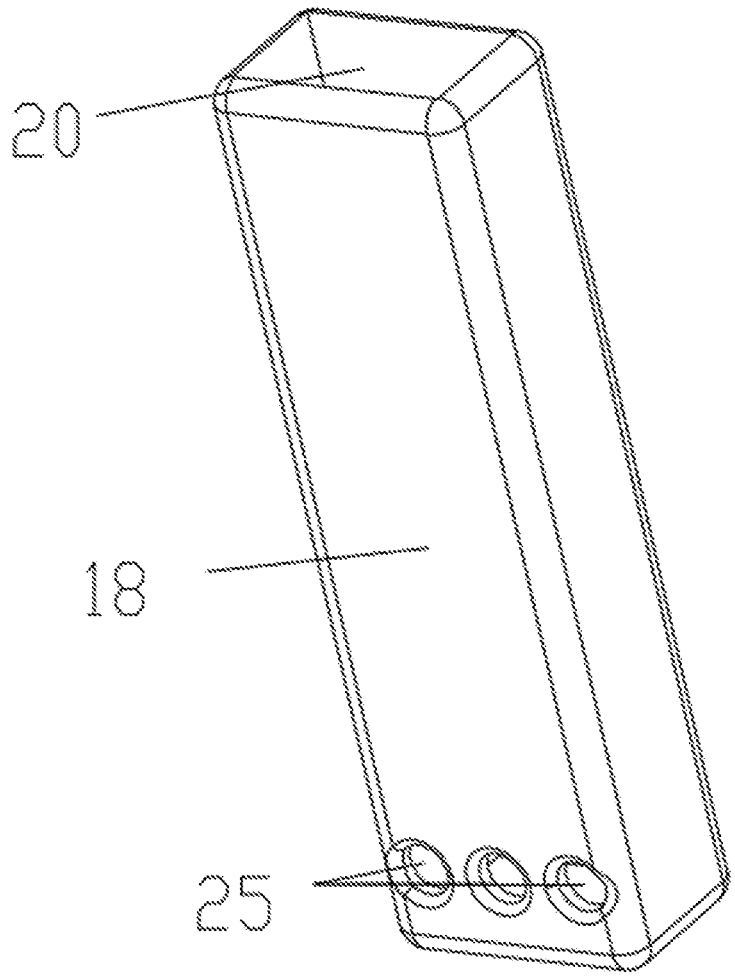
FIG. 7 shows a schematic view of the structure of the electrical connecting head according to the present application.

With reference to FIGS. 1 to 7, a telescopic conductive tube is provided in the present application, including a telescopic assembly 26 and a conductive assembly 10. The telescopic assembly 26 is provided with a first tube body 34 and a second tube body 37 that can be relatively telescopic. The conductive assembly 10 is installed along the outside of the first tube body 34 and the second tube body 37. The conductive assembly 10 includes a conductive wire 15, a receiving aluminum tube 16 for accommodating the conductive wire 15, an electrical connecting head 18 electrically connected to the conductive wire 15, a conductive copper sheet 21 electrically connected to the electrical connecting head 18, and an insulated guide rail 22 for fixing the conductive copper sheet 21. The receiving aluminum tube 16 is installed on the outside of the first tube body 34. The insulated guide rail 22 is fixedly installed in the second tube body 37. The conductive wire 15 is electrically connected with an elastic contact 19, and the elastic contact 19 protrudes from the inside to the outside of the electrical connecting head 18. The electrical connecting head 18 is electrically connected to the conductive copper sheet 21 through the elastic contact 19. The electrical connecting head 18 and the conductive copper sheet 21 being capable of sliding relatively and maintaining electrical connection. The electrical connecting head 18 is provided with three through holes 25, and the elastic contact 19 extend from the through holes 25. The telescopic assembly 26 is also provided with a first fixing head 27, a second fixing head 29 and a locking component 31. The first fixing head 27 is fixedly installed at the end of the first tube body 34. The locking component 31 is fixedly installed on one end of the second tube body 37, and the second fixing head 29 is fixedly installed on the other end of the second tube body 37. The first tube body 34 penetrates the locking component 31 and is inserted into the second tube body 37 to form a movable connection with the second tube body 37. The first fixing head 27 is provided with a first fixing groove 28, and the second fixing head 29 is provided with a second fixing groove 30. One end of the conductive assembly 10 is fixedly installed in the first fixing groove 28, while the other end is fixedly installed in the second fixing groove 30. The locking component 31 is provided with a third fixing groove 33. The second tube body 37 is provided with a mounting tube 38, and the end of the mounting tube 38 is fixedly installed in the third fixing groove 33. The insulated guide rail 22 is fixedly installed in the mounting tube 38. The first tube body 34 is provided with a positioning groove 35 and a snapping band 36, and the snapping band 36 is fixedly installed in the positioning groove 35. The locking component 31 is also provided with a button 32, through which the locking component 31 and the snapping band 36 can be connected to each other in a snap-fit connection.

In this embodiment, a row of snapping holes is provided on the snapping band 36, and the bottom of the button 32 can be engaged with the snapping holes, so that the length of first tube body 34 extending into the second tube body 37 can be adjusted through the cooperation of the button 32 and the snapping band 36. The receiving aluminum tube 16 is fixedly connected to the first tube body 34. The insulated guide rail 22 is fixedly installed in the second tube body 37. And the receiving aluminum tube 16 and the insulated guide rail 22 are movably connected through the electrical connecting head 18. When the electrical connecting head 18 slides in the insulated guide rail 22, the receiving aluminum tube 16 also follows the electrical connecting head 18 to slide in the insulated guide rail 22.

Further, the insulated guide rail 22 is provided with a limiting groove 23 and a receiving cavity 24 connected with the limiting groove 23. The limiting groove 23 is provided at the bottom of the insulated guide rail 22. The conductive copper sheet 21 is fixedly installed in the limiting groove 23.

In this embodiment, the bottom of the insulated guide rail 22 is provided with three limiting grooves 23, and one conductive copper sheet 21 is fixedly installed in each limiting groove 23. Because the receiving cavity 24 is connected with the limiting groove 23, when the electrical connecting head 18 slides in the receiving cavity 24, both sides of the electrical connecting head 18 being capable of maintaining electrical connection with the conductive copper sheet 21.

Further, the conductive assembly 10 further includes a first electrode connecting head 11 and a first connecting head 12 is provided on the first electrode connecting head 11. A second connecting head 17 is provided on the receiving aluminum tube 16. The conductive wire 15 extends out of the receiving aluminum tube 16 and is electrically connected to the electrode in the first electrode connecting head 11, and the first connecting head 12 is fixedly connected to the second connecting head 17.

In this embodiment, the first electrode connecting head 11 is provided with positive and negative electrodes. There are two conductive wires 15 which are electrically connected to the positive and negative electrodes respectively. The first connecting head 12 and the second connecting head 17 are fixedly connected, so that the first electrode head 12 and the receiving aluminum tube 16 form a fixed connection. When the telescopic assembly 26 and the conductive assembly 10 are assembled together, the first electrode connecting head 11 is fixedly installed in the first fixing groove 28.

Further, the electrical connecting head 18 is provided with an plug-in connecting cavity 20, and the receiving aluminum tube 16 is inserted into the plug-in connecting cavity 20 so that the electrical connecting head 18 is fixedly connected to the receiving aluminum tube 16.

Further, the conductive assembly 10 further includes a second electrode connecting head 13, which is provided with a snap connecting head 14. The snap connecting head 14 fixedly snaps the end of the insulated guide rail 22 on the second electrode connecting head 13. The conductive copper sheet 21 extends from the insulated guide rail 22 into the second electrode connecting head 13 to be electrically connected to the electrodes inside the second electrode connecting head 13.

In this embodiment, when the telescopic assembly 26 and the conductive assembly 10 are assembled together, the second electrode connecting head 13 is fixedly installed in the second fixing groove 30. The first electrode connecting head 11 and the second electrode connecting head 13 enable the telescopic conductive tube to be installed on a vacuum cleaner. One end of the telescopic conductive tube is electrically connected to the vacuum head of the vacuum cleaner, and the other end of the telescopic conductive tube is electrically connected with the handheld electric terminal of the vacuum cleaner.

It should be noted that the present application may have other various embodiments. Modifications and variations made by those skilled in the art based on the embodiments according to the present application without any creative work also fall within the scope of the present application.

What is claimed is:

1. A telescopic conductive tube, comprising a telescopic assembly and a conductive assembly, wherein the telescopic assembly is provided with a first tube body and a second tube body relatively telescopic to the first tube body, and the conductive assembly is installed along the outside of the first tube body and the second tube body, wherein the conductive assembly comprises a conductive wire, a receiving aluminum tube for accommodating the conductive wire, wherein the receiving aluminum tube is installed on the outside of the first tube body, an electrical connecting head electrically connected to the conductive wire, a conductive copper sheet electrically connected to the electrical connecting head, and an insulated guide rail for fixing the conductive copper sheet, wherein the insulated guide rail is fixedly installed in the second tube body, wherein the conductive wire is electrically connected with an elastic contact protruding from the inside to the outside of the electrical connecting head, the electrical connecting head being electrically connected to the conductive copper sheet through the elastic contact, and the electrical connecting head and the conductive copper sheet being capable of sliding relatively and maintaining electrical connection; and wherein the electrical connecting head is provided with a plug-in connecting cavity, and the receiving aluminum tube is inserted into the plug-in connecting cavity, making the electrical connecting head fixedly connected to the receiving aluminum tube.

2. The telescopic conductive tube according to claim 1, wherein the insulated guide rail is provided with a limiting groove and a receiving cavity connected with the limiting groove, wherein the limiting groove is provided at the bottom of the insulated guide rail, and the conductive copper sheet is fixedly installed in the limiting groove.

3. The telescopic conductive tube according to claim 1, wherein the conductive assembly further comprises a first electrode connecting head provided with a first connecting head, and the receiving aluminum tube is provided with a second connecting head fixedly connected to the first connecting head, wherein the conductive wire extends out of the receiving aluminum tube and is electrically connected to an electrode in the first electrode connecting head.

4. The telescopic conductive tube according to claim 1, wherein the conductive assembly further comprises a second electrode connecting head provided with a snap connecting head, wherein the snap connecting head fixedly snaps an end of the insulated guide rail on the second electrode connecting head, and the conductive copper sheet extends from the insulated guide rail into the second electrode connecting head to be electrically connected to an electrode inside the second electrode connecting head.

5. The telescopic conductive tube according to claim 1, wherein the telescopic assembly is further provided with a first fixing head fixedly installed at the end of the first tube body, a locking component fixedly installed on one end of the second tube body, and a second fixing head fixedly installed on the other end of the second tube body, wherein the first tube body penetrates the locking component and is inserted into the second tube body to form an movable connection with the second tube body.

6. The telescopic conductive tube according to claim 5, wherein the first fixing head is provided with a first fixing groove, and the second fixing head is provided with a second fixing groove, wherein one end of the conductive assembly is fixedly installed in the first fixing groove, and the other end of the conductive assembly is fixedly installed in the second fixing groove.

7. The telescopic conductive tube according to claim 5, wherein the locking component is provided with a third fixing groove, and the second tube body is provided with a mounting tube, wherein an end of the mounting tube is fixedly installed in the third fixing groove, and the insulated guide rail is fixedly installed in the mounting tube.

8. The telescopic conductive tube according to claim 5, wherein the first tube body is provided with a positioning groove and a snapping band, and the snapping band is fixedly installed in the positioning groove.

9. The telescopic conductive tube according to claim 8, wherein the locking component is further provided with a button, thereby the locking component and the snapping band are capable of being connected to each other in a snap-fit connection.

* * * * *